US008517216B2

(12) United States Patent
MacDougall

(10) Patent No.: US 8,517,216 B2
(45) Date of Patent: Aug. 27, 2013

(54) ANGLED SPOUT DISPENSING DEVICE

(76) Inventor: Kenneth L. MacDougall, Waverley (CA)

( * ) Notice: Subject to any disclaimer, the term of this patent is extended or adjusted under 35 U.S.C. 154(b) by 320 days.

(21) Appl. No.: 12/923,631

(22) Filed: Sep. 30, 2010

(65) Prior Publication Data

US 2011/0084090 A1 Apr. 14, 2011

(51) Int. Cl.
*B67D 7/06* (2010.01)

(52) U.S. Cl.
USPC ..... 222/1; 222/538; 222/481.5; 222/568

(58) Field of Classification Search
USPC ..... 222/1, 538, 481.5, 525, 529, 530, 222/522, 526, 519, 568
See application file for complete search history.

(56) References Cited

U.S. PATENT DOCUMENTS

| | | | | | |
|---|---|---|---|---|---|
| 1,468,360 | A * | 9/1923 | Frey | 222/522 |
| 1,893,562 | A * | 1/1933 | Paasche | 239/143 |
| 2,723,056 | A * | 11/1955 | Smith | 222/396 |
| 2,736,469 | A * | 2/1956 | Stone | 222/529 |
| 2,791,357 | A * | 5/1957 | Nelson | 222/525 |
| 2,862,515 | A * | 12/1958 | Briechle | 137/234.5 |
| 3,929,264 | A * | 12/1975 | Maynard, Jr. | 222/525 |
| 4,069,946 | A * | 1/1978 | Flider | 222/1 |
| 4,129,236 | A * | 12/1978 | Wrycraft et al. | 222/570 |
| 4,311,259 | A * | 1/1982 | Babiol | 222/525 |
| 4,426,027 | A * | 1/1984 | Maynard, Jr. | 222/529 |
| 4,726,491 | A * | 2/1988 | Moon | 222/1 |
| 5,000,360 | A * | 3/1991 | Lown et al. | 222/521 |
| 6,068,163 | A * | 5/2000 | Kihm | 222/189.1 |
| 6,588,264 | B1 * | 7/2003 | Johnson | 73/146.8 |
| 6,659,426 | B2 * | 12/2003 | Schroeder et al. | 251/149.6 |
| 6,814,267 | B2 | 11/2004 | Ingram | |
| 7,128,108 | B2 * | 10/2006 | Nielsen | 141/351 |
| 2001/0035208 | A1 * | 11/2001 | Cromwell et al. | 137/205 |
| 2005/0236440 | A1 * | 10/2005 | Cho | 222/519 |
| 2005/0247371 | A1 * | 11/2005 | Chadbourne et al. | 141/351 |
| 2007/0075102 | A1 * | 4/2007 | Moore | 222/519 |
| 2008/0006792 | A1 * | 1/2008 | Hasunuma | 251/205 |
| 2008/0295817 | A1 * | 12/2008 | Stevens | 124/73 |

FOREIGN PATENT DOCUMENTS

CA 2703183 A1 10/2011

* cited by examiner

*Primary Examiner* — Kevin P Shaver
*Assistant Examiner* — Patrick M Buechner
(74) *Attorney, Agent, or Firm* — Brooks Kushman P.C.

(57) ABSTRACT

A container dispensing device is provided having a storage mode and a dispensing mode. A pouring spout includes threaded first and second ends and functions at all times inside both a draw sleeve having a corresponding interior engaging mechanism. The draw sleeve is positioned directly above an exterior threaded upper extension of the first cap, which remains attached at all times to the container by a first engaging mechanism. A second cap is provided to cover the second end of the spout and secure the spout to the first cap. To convert the dispensing device from the storage mode to the dispensing mode, a user unscrews the second cap from the first cap, draws the spout from the container, and tightens the draw sleeve to engage the threaded first end of the spout with the corresponding interior engaging mechanism of the draw sleeve.

14 Claims, 8 Drawing Sheets

All - 100

ANGLED SPOUT DISPENSING DEVICE

FIELD OF THE INVENTION

The present invention relates to a dispensing device for attachment to a portable container, and more particularly to a dispensing device enabling simple conversion from a storage mode to a dispensing mode, including provision for air flow.

BACKGROUND OF THE INVENTION

Dispensing devices of some conventional portable fuel containers are usually converted from a storage mode to a dispensing mode by: unscrewing a cap of the dispensing device from the container; withdrawing with one hand the spout, which has been immersed in fuel, and turning the same end to end; removing a plate covering an opening in the cap; inserting the turned spout through the opening; and again screwing the cap with the inserted spout onto the container. The handling of the fuel covered spout requires wearing gloves or washing of hands each time, after handling, which is particularly awkward when the portable fuel container is used for purposes such as, for example, boating or gardening. Turning a fuel immersed spout causes spillage of fuel which is environmentally harmful, even in small quantities.

Some dispensing devices of conventional portable fuel containers provide a stopper for closing the container with the spout protruding, to enable easy access when the fuel container is not in a storage mode. However, the stopper is easily lost or misplaced, and fuel containers left in this configuration pose a safety hazard.

Devices attempting to dispense liquids without providing adequate passage of air to a container do not function acceptably, and some others that open only when pushed down onto a receptacle, spray fuel in all directions, thus creating an environmental hazard, rather than being a safety measure, whereas the present invention functions efficiently and safely with close to zero environmental impact.

It is desirable to provide a container dispensing device that is easily converted from a storage mode to a dispensing mode without directly handling a fuel covered spout.

It is also desirable to provide a dispensing device that closes the fuel container, optionally, with the spout protruding, to dispense fuel in a substantially safe fashion.

Also, it is desirable to provide a dispensing device that has an angled or straight spout which may be rotated to and secured at any desired position by a threaded sleeve which draws the spout's lower flange upward under a lower cap in a sealed fashion.

It is desirable to provide a dispensing device in which a holding mechanism of a second cap has a protruding center pin which facilitates air flow to a container.

Many prior art examples of container dispensing devices have been studied and all found to have dissimilar features and functions. For example, U.S. Pat. No. 4,076,151 A (Littlefield, H. B.) and U.S. Pat. No. 4,311,259 A (Babiol, P.) among others, and while U.S. Pat. No. 3,804,305 A (Rieke, G. T.), provides a spout with exterior threads, it is rotated upward into the container to form a seal, a function differing from the present invention.

SUMMARY OF THE INVENTION

Accordingly, one object of the present invention is to provide a container dispensing device which may easily be converted from a storage mode to a dispensing mode handling only dry exterior surfaces of both a second cap and a draw sleeve.

Another object of the present invention is to provide a container dispensing device in which the exterior of a draw sleeve is kept dry by upper and lower seals within a second cap, in a storage mode.

A further object of the present invention is to provide a container dispensing device in which a pouring spout comprises a threaded first end portion and a second end angled configuration having exterior engaging mechanism designed to engage the interior engaging mechanism of a draw sleeve.

Another object of the present invention is to provide a container dispensing device in which a pouring spout is positioned and functions at all times, inside both a first cap, and a draw sleeve.

A further object of the present invention is to provide a container dispensing device wherein a draw sleeve houses an interior engaging mechanism.

Another object of the present invention is to provide a container dispensing device in which a pouring spout is placed at any desired angle position within a container, prior to being converted to a dispensing mode.

A further object of the present invention is to provide a container dispensing device in which the second end outer flange of a pouring spout is drawn to a respective surface under a first cap in a sealed fashion, by clockwise rotation of a draw sleeve.

A further object of the present invention is to provide a container dispensing device in which a draw sleeve rests upon a multi-functional seal cemented to a top edge of an upper extension of a first cap.

Another object of the present invention is to provide a container dispensing device wherein, in a dispensing mode, clockwise rotation of a second cap holding mechanism onto an exterior threaded air vent, causes its protruding center pin to temporarily open an air valve, enabling passage of air to, or from, the container.

Another object of the present invention is to provide a container dispensing device in which conversion from a storage mode to a dispensing mode, and vice versa, is accomplished by utilizing a draw sleeve.

A further object of the present invention is to provide a container dispensing device wherein a draw sleeve is positioned directly above an upper extension of a first cap.

Another object of the present invention is to provide a container dispensing device wherein a second cap houses a draw sleeve in a storage mode.

Another object of the present invention is to provide a container dispensing device in which the exterior of a draw sleeve is kept dry in a storage mode, by upper and lower seals housed within a second cap.

A further object of the present invention is to provide a container dispensing device wherein a pouring spout may be released and returned to a storage position by counter rotation of a draw sleeve.

Another object of the present invention is to provide a container dispensing device wherein, in a dispensing mode, counter-clockwise rotation and removal of a second cap holding mechanism from an existing or manufactured exterior threaded air vent, causes its protruding center pin to close a container air valve positioned therein.

According to a preferred manifestation of the present invention, there is provided a dispensing device. The dispensing device comprises a pouring spout, having a threaded first end portion and second end angled configuration with exterior engaging mechanism, and an outer end flange. A first cap is comprised of an upper exterior threaded extension and lower engaging mechanism with which a respective container opening portion is engaged; it also features a center opening for movably accommodating the spout therein between a retracted storage position, with its first end portion and the draw sleeve with interior engaging mechanism, housed in the opening, and an extended position with the opposite second end portion of the spout being accommodated therein, in the dispensing mode. A second cap, second engaging mechanism, provides for temporarily engaging a respective outer threaded upper extension of the first cap for covering the opening of the first cap and the threaded first end portion of the spout in a sealed fashion, in the storage mode. A holding mechanism engaging the threaded first end portion of the spout is housed within the second cap, which is disconnected from the exterior engaging mechanism of the upper extension of the first cap by counter-clockwise rotation. The spout is withdrawn, held at a desired angle, and the draw sleeve, positioned upon a multi-functional seal, cemented to the top edge upper extension of the first cap, is rotated clockwise engaging the exterior engaging mechanism of the spout's second end, drawing its outer end flange to a surface under the first cap in a sealed fashion, thereby placing the spout in the dispensing mode.

The second cap is rotated, for example, counter-clockwise and its centered holding mechanism uncovers the threaded first end portion of the spout for pouring, after which it is placed and rotated clockwise onto a closed exterior threaded air vent enabling its protruding center pin to depresses and temporarily open the air valve positioned therein, allowing passage of air to the container. Optionally, the air valve may be hand operated. The air valve is closed by counter rotation and withdrawal of the protruding center pin, and the holding mechanism again rotated onto the spout's first end. Reversing the procedures above restores the device from a dispensing mode to a storage mode.

Advantages of the present invention are to provide a dispensing device, quickly converted from a storage mode to a dispensing mode by handling only the dry exteriors of both a second cap and a draw sleeve. The device may be used repeatedly and safely with the spout protruding. The first cap remains engaged with the container at all times and the second cap is not set aside, except if manual operation is desired, but is moved directly from the spout to the air vent/valve, providing adequate air flow, and vice-versa. Also, in the dispensing mode, the second cap may be temporarily turned to a slightly open position to relieve expansion or contraction pressures inside the container. The multi-functional seal is cemented to the top edge of the upper extension of the first cap to keep the under side of the draw sleeve dry in the storage mode, to deter its own removal while operating, and provide a base upon which to adequately function.

A further object of the present invention is to provide a variation wherein an upper extension of a first cap, having exterior threads, is inserted through or otherwise attached to existing or manufactured fuel container caps, thus providing a means of converting them to accommodate the components and perform the functions of the present invention.

Another object of the present invention is to provide a conversion kit comprising an air valve extension designed to fit onto existing or manufactured exterior threaded container air vents, housing an air valve, located and designed to be operated by a protruding center pin of a second cap holding mechanism, or manually.

BRIEF DESCRIPTION OF THE DRAWINGS

A preferred embodiment of the present invention is described below with reference to the accompanying drawings, in which.

DESCRIPTION OF A PREFERRED EMBODIMENT

Figure 1:
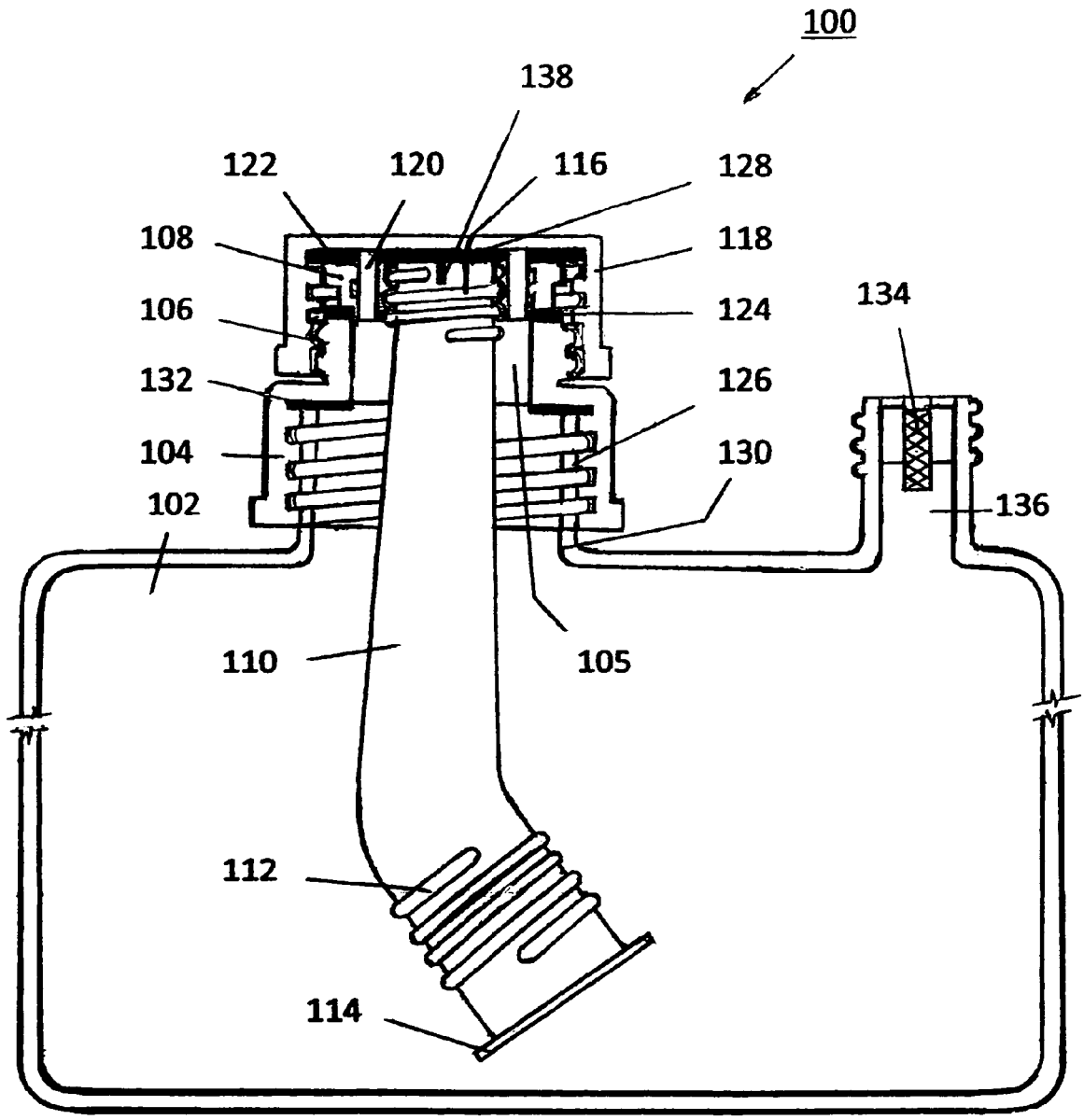
FIG. 1 is a simplified block diagram illustrating a cross sectional view of a container angled spout dispensing device according to a preferred embodiment, in a storage mode.

Technical terms used herein have the same meaning as commonly understood by one of ordinary skill in the art to which the invention belongs. Similar or equivalent methods and materials may be used in the practice or testing of the present invention, the preferred methods and materials are herein described.

While the description of the preferred embodiments herein below is with reference to a dispensing device for a portable fuel container, however, the embodiments of the invention are not limited thereto, but are also applicable for dispensing various other liquid as well as solid materials in, for example, granular or powder form.

Referring to FIGS. 1 to 4, an angled or straight container dispensing device spout 100 according to a preferred embodiment of the invention is provided. Dispensing device 100 comprises a first cap (104) having a first engaging mechanism (126), for example a screw thread, for engaging a respective exterior threaded opening (130) of a container (102). A first cap (104) comprises an open center for movably accommodating a pouring spout with angled configuration (110) therein between a retracted position with threaded first end portion (116) of the spout being accommodated in the opening (105)—illustrated in FIG. 1—and an extended position with opposite second end exterior threaded portion (112) of the spout being accommodated in opening (105)—illustrated in FIG. 2—first cap (104) remains engaged with opening of container (102) at all times. A second cap (118) comprises a second interior engaging mechanism for engaging an exterior threaded upper extension (106) of first cap (104), the upper edge of which houses multi-functional seal (124). While engaged with upper extension of first cap (106), second cap (118) covers opening (105) of first cap (104) and threaded first end portion (116) of spout (110). Second cap (118) houses holding mechanism (120) to engage threaded first end portion (116) of spout (110)—using, for example respective screw threads. Holding mechanism (120), centrally housing protruding center pin (138) is configured for rotation onto exterior threaded air vent (136), temporarily engaging and depressing air valve (134), causing it to open, enabling free passage of air to container (102). Either mechanical or manual release of air valve (134), causes it to be securely closed—illustrated in FIG. 11. The pouring spout (110) is formed, for example, of circular cross section with the second end consisting of angled or straight configuration with exterior threaded engaging mechanism (112) ending in outer flange (114), illustrated in FIG. 1.

Container fuel dispensing device 100 employs wide seal (132) disposed in first cap (104) the outer portion of which engages the upper end of opening (130) of container (102) in a sealed fashion; the inner portion of seal (132) provides a seal for the outer end flange (114) of spout (110) as it is drawn upward by clockwise rotation of draw sleeve, (108); seal (122) is disposed in second cap (118) for engaging the upper side of draw sleeve (108) in a sealed fashion; multi-functional seal (124) is secured to the upper edge of upper extension of first cap (106) to abut the lower side of draw sleeve (108) in a sealed fashion, in the storage mode; seal (128) is disposed in second cap (118) to abut threaded first end portion (116) of spout (110) in a sealed fashion. The seals are, for example, washers or O-rings made of elastic material such as rubber or neoprene, and are, for example, dimensioned to fit snugly into respective locations of the first cap (104) and the second cap (118).

Figure 2:
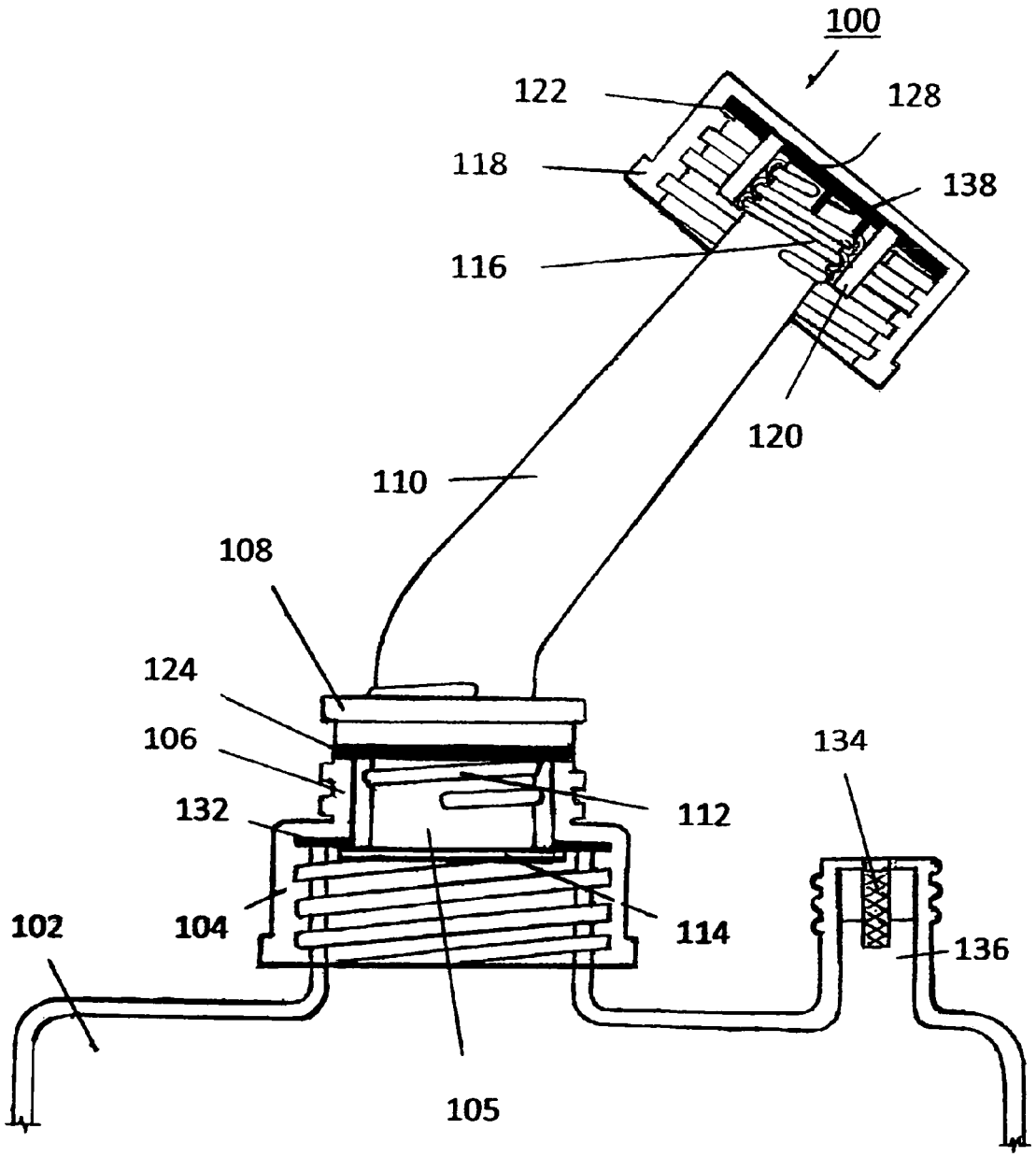
FIG. 2 is a simplified block diagram illustrating a side view of a draw sleeve, and a cross sectional view of a container angled spout dispensing device in an extended position dispensing mode.
Figure 3:
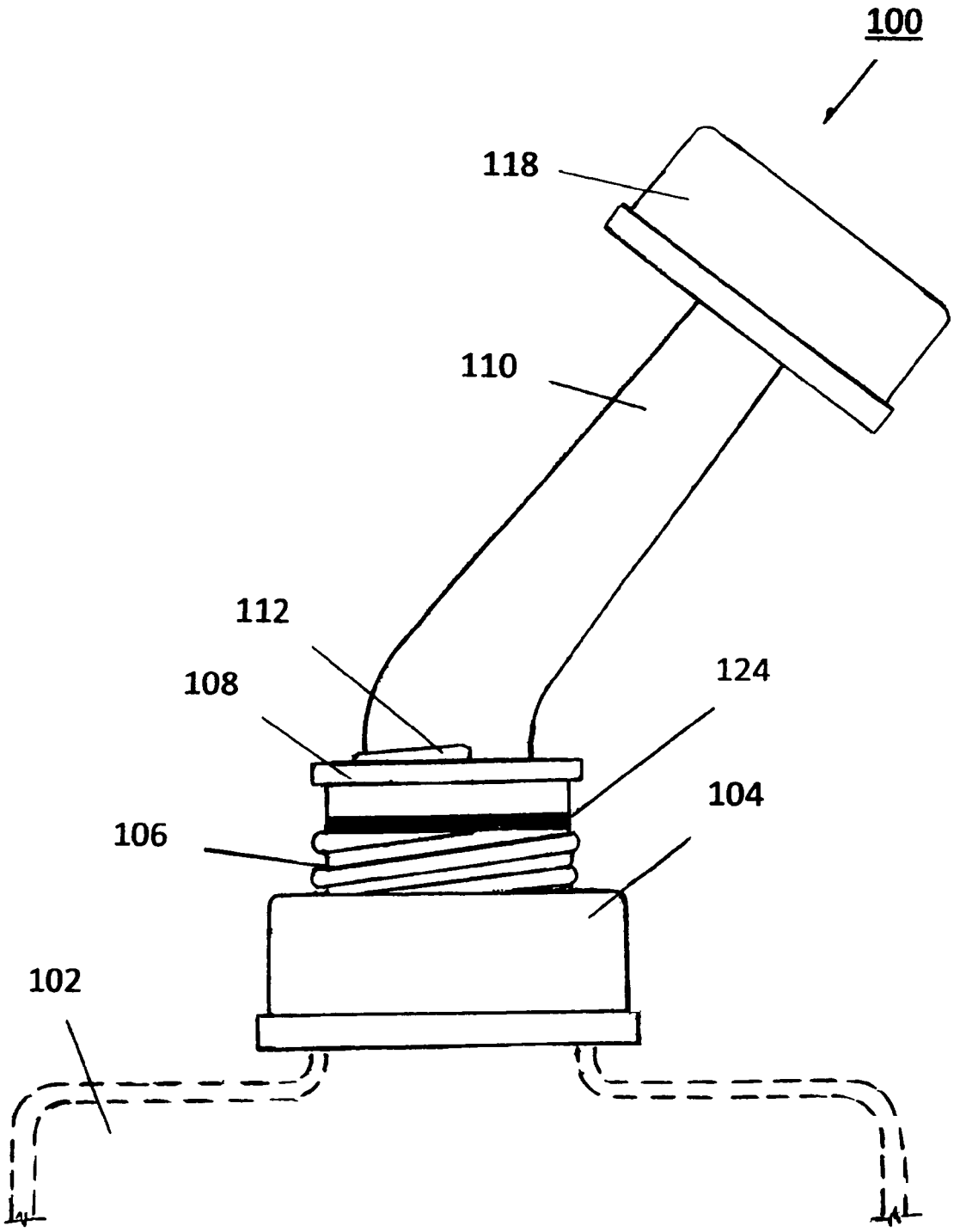
FIG. 3 is a simplified block diagram illustrating a side view of a container angled spout dispensing device in a closed dispensing mode.
Figure 4:
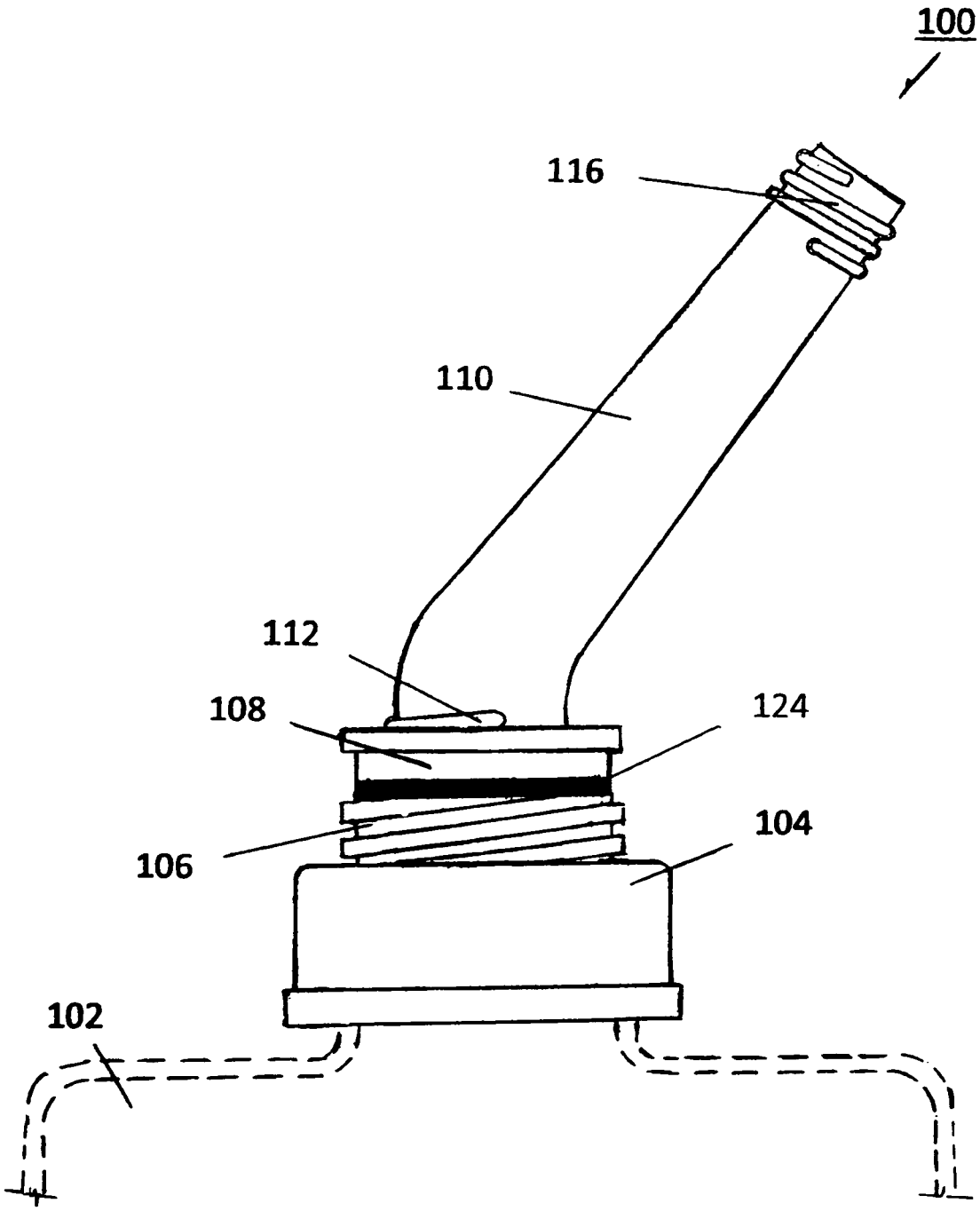
FIG. 4 is a simplified block diagram illustrating a side view of a container angled spout dispensing device in an open dispensing mode.

The container fuel dispensing device 100 is converted from a storage mode—illustrated in FIG. 1—to a dispensing mode—illustrated in FIGS. 2, 3 and 4—by performing, for example, the following steps: second cap (118) is disconnected from upper extension (106) of first cap (104) by counter-clockwise rotation; its engaged spout with angled configuration (110) is rotated to a desired angle position inside container (102), and withdrawn to a point of contact between its second end exterior threaded mechanism (112) and corresponding interior threaded mechanism of the draw sleeve (108); clockwise rotation of which draws outer end flange (114) of spout (110) firmly against seal (132) under first cap (104) in a sealed fashion; second cap (118) is rotated, for example, counter-clockwise causing its holding mechanism (120) to disengage from threaded first end portion (116) of spout (110) and placed onto exterior threaded air vent (136) clockwise rotation of which causes its protruding center pin (138) to temporarily depress and open air valve (134) enabling passage of air to container (102); after pouring, holding mechanism (120) is counter rotated and disengaged from exterior threaded air vent (136) causing air valve (134) to be securely closed.

Provision of seal (128) in second cap 118 enables the container to be utilized repeatedly with spout (110) in an extended position in a sealed fashion, i.e. egress of fuel when the container is in a position other than upright, is prevented.

Expansion or contraction pressures inside container (102) may be alleviated by temporary counter-clockwise rotation of second cap (118) enabling passage of air.

Figure 5:
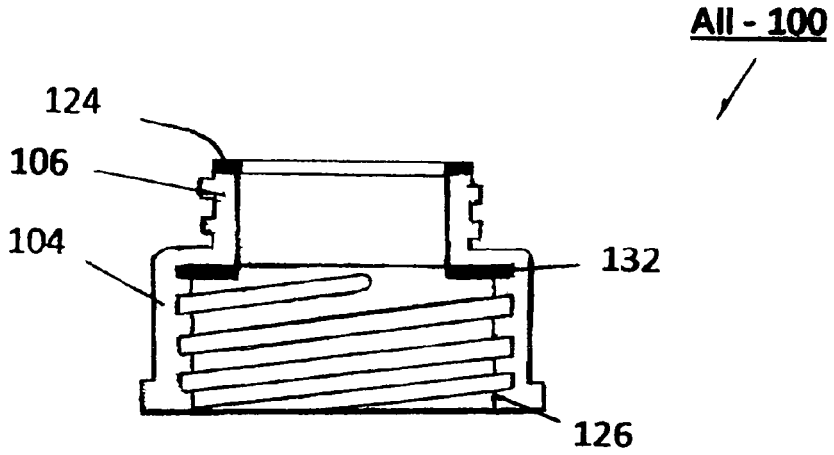
FIGS. 5 and 6 are simplified block diagrams illustrating in order, a cross sectional side view and bottom view of a first cap.

FIG. 5 illustrates a cross sectional side view of first cap (104) first engaging mechanism (126) upper extension (106) and multi-functional seal (124) wide seal (132), the outer portion of which meets top of container (130), and inner portion of which contacts outer end flange (114) of spout (110), both in a sealed fashion.

Figure 6:
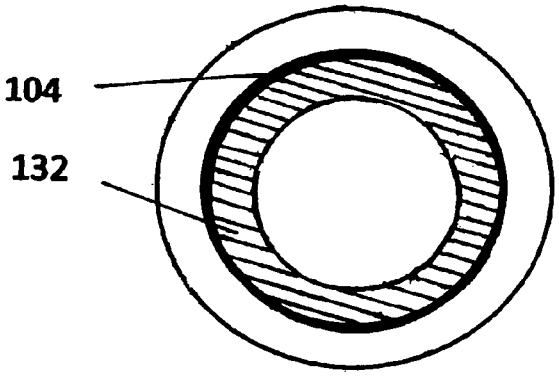

FIG. 6 illustrates the underside view of the first cap (104) and seal (132).

Figure 7:
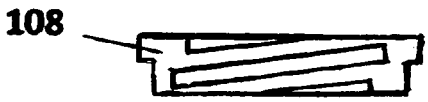
FIGS. 7 and 8 are simplified block diagrams illustrating in order, a cross sectional side view and a bottom view of a draw sleeve having interior threads.
Figure 8:
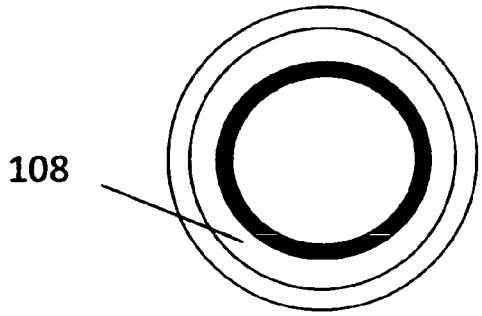

FIG. 7 illustrates a cross sectional side view of draw sleeve (108), and FIG. 8 its underside view.

Figure 9:
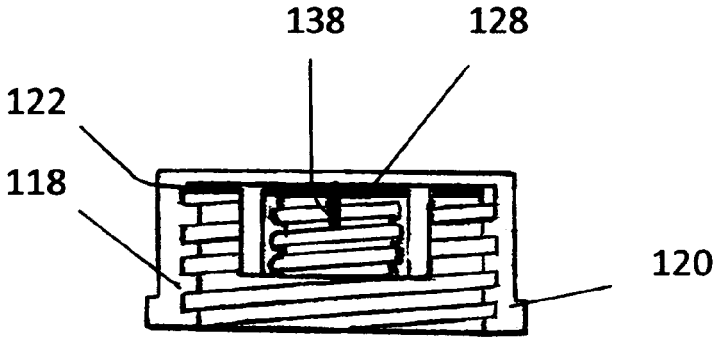
FIGS. 9 and 10 are simplified block diagrams illustrating in order, a cross sectional side view and a bottom view of a second cap.

FIG. 9 illustrates a cross sectional view of a second cap with second engaging mechanism (118) and centered holding mechanism (120) housing protruding center pin (138), and seals (122) and (128).

Figure 10:
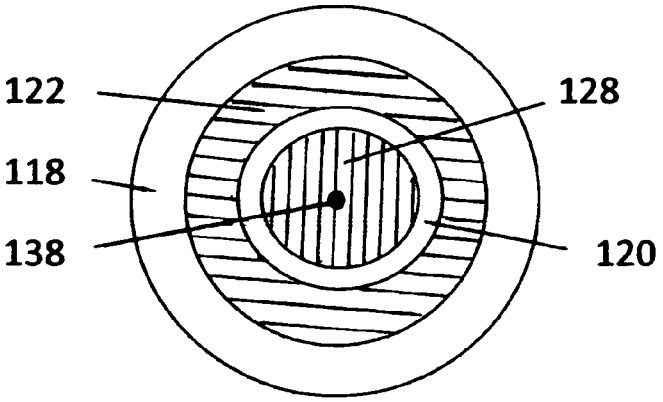

FIG. 10 illustrates a underside view of second cap (118) holding mechanism (120), protruding center pin (138), seals (122) and (128).

Figure 11:
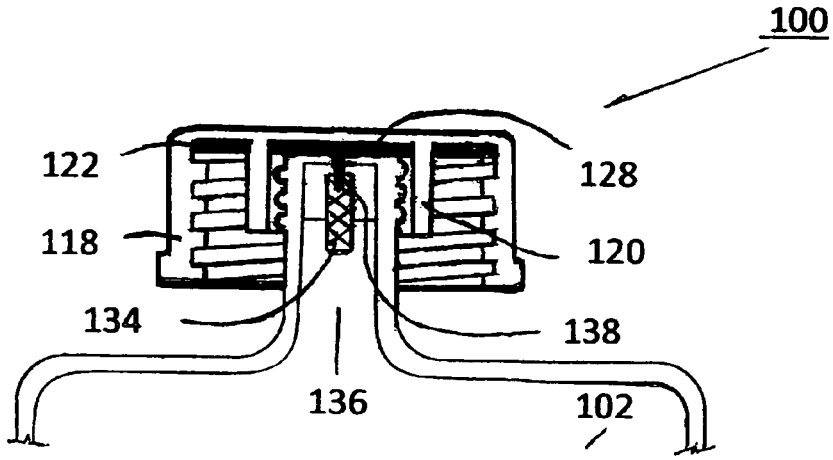
FIG. 11 is a simplified block diagram illustrating a cross sectional side view of a second cap second engaging mechanism and holding mechanism with protruding center pin.

FIG. 11 illustrates a cross sectional side view of a second cap with second engaging mechanism (118) holding mechanism (120) protruding center pin (138) exterior threaded air vent (136) air valve (134) on container (102), and seals (122) and (128).

Figure 12:
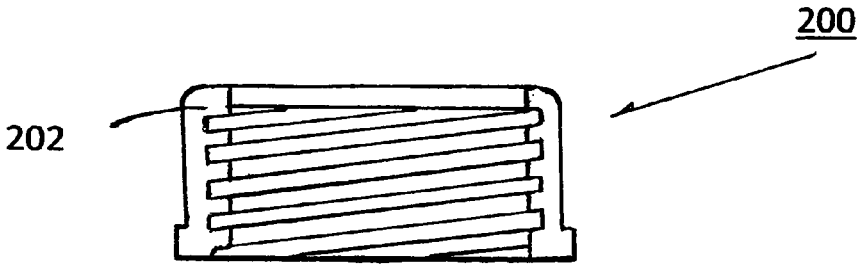
FIGS. 12, 13, 14 and 15 are simplified block diagrams of the 200 manifestation of the present invention with cross sectional side views, illustrating in order; an existing or manufactured fuel container cap—FIG. 12; an upper extension insert for a cap—FIG. 13; the two preceding components attached or cemented together—FIG. 14; an interior threaded extension sleeve, housing an air valve, designed to rotate onto existing or manufactured container air vents—FIG. 15.
Figure 13:
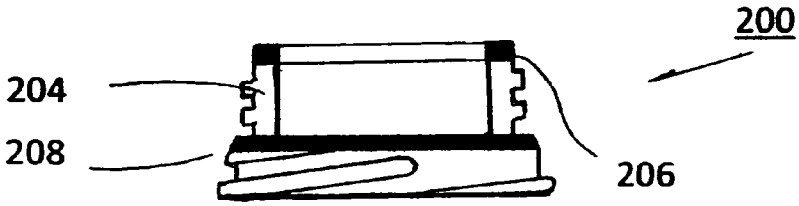
Figure 14:
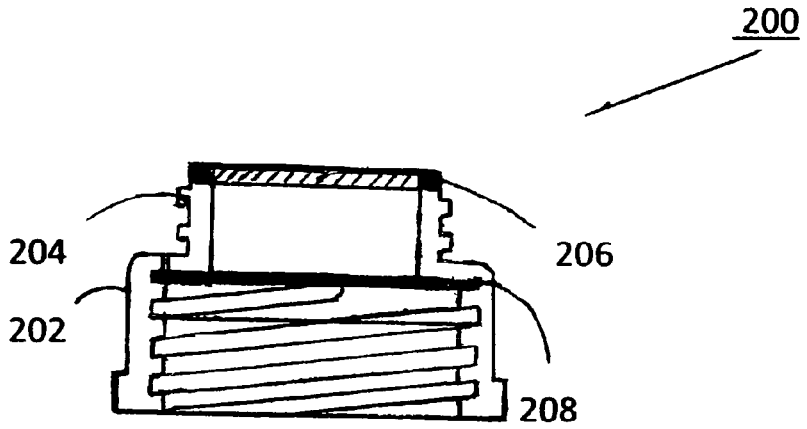
Figure 15:
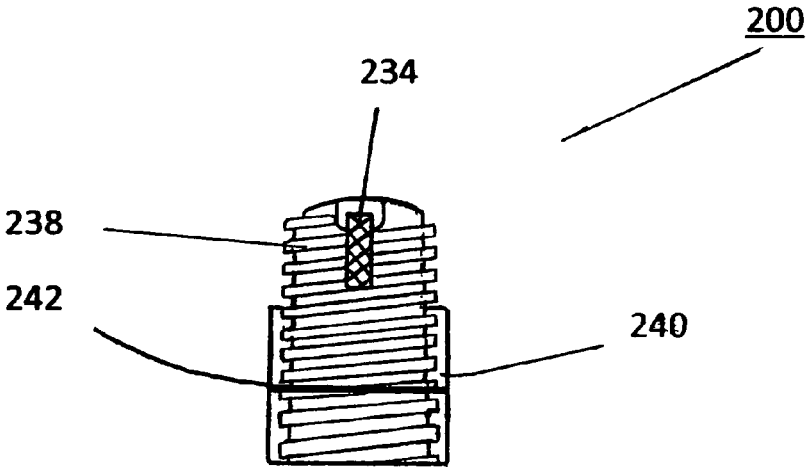

The present invention has been described herein with regard to preferred embodiments however, an additional 200 variation may provide an upper extension insert (204)—FIG. 13, for converting existing fuel and other container caps (202)—FIG. 12, assembled together utilizing cemented seal (208), forming a first cap with upper outer threaded extension, illustrated in FIG. 14. The lower interior threaded section of air vent extension sleeve (240), illustrated in FIG. 15, rotates onto existing or manufactured exterior threaded air vents of containers, sealed by (242) thereby providing an exterior threaded air vent (238) with inserted air valve (234). The 200 components above, utilizing 100 components of the present invention, i.e. the pouring spout (110), draw sleeve (108), first cap (104) upper extension (106) and all components of the second cap (118), together provide a kit for converting existing fuel containers to incorporate the basic features and functions of the present invention.

INDUSTRIAL APPLICABILITY

The portable fuel container marketplace has many unsatisfactory dispensing devices that do not function acceptably and safely for a variety of reasons, the continuing operation of which, poses an ongoing environmental hazard. However, the present invention provides quick conversion from a storage to a dispensing mode without touching a fuel covered surface, and air circulation facilitates easy pouring, thus functioning with close to zero environmental impact. Expansion and contraction pressures in a container may be relieved simply by loosening the second cap to allow passage of air to the spout. Manifestation 200 provides a kit for converting existing portable fuel containers, designed to utilize the features and components of the present invention and bring them to an acceptable standard of convenience and safety.

The invention claimed is:

1. A method for converting a container from a storage mode to a dispensing mode, said container having a first cap with an interior engaging mechanism and an upper extension with exterior engaging mechanism, a pouring spout with an exterior engaging mechanism on a first end thereof ending in an outer end flange, a second cap having an interior engaging mechanism for securing with a threaded first end of said spout, and a draw sleeve disposed about the spout, said method comprising the steps of:

rotating the second cap counter-clockwise to remove it from the upper extension of the first cap;

rotating the draw sleeve onto the exterior engaging mechanism on the first end of the spout to draw the flange to a respective surface under the first cap in a sealed fashion;

rotating the second cap counter-clockwise to a point of disconnection, providing open access within the spout, enabling egress of materials disposed therein; and rotating the second cap clockwise onto a closed exterior threaded container air vent, causing a protruding center pin within the second cap to temporarily open air valve, facilitating passage of air to container.

2. A dispensing assembly for attachment to a container, the dispensing assembly comprising:

a tubular spout having a proximal end portion and a distal end portion, each end portion having a threaded portion;

a first cap for securing to an outlet of a container, the first cap having an opening aligned with an opening of the outlet to provide a passage for the spout to move between a refracted position and an extended position;

a second cap having a first threaded portion for cooperating with the threaded portion on the distal end portion of the spout, and a second threaded portion for cooperating with an external threaded portion on the first cap; and a rotatable draw sleeve disposed about the spout, the draw sleeve having internal threading cooperating with the threaded portion of the proximal end portion of the spout, wherein rotation of the draw sleeve draws the spout outwardly from the container to affix the spout in the extended position.

3. The dispensing assembly of claim 2, wherein the container includes an exterior threaded air vent having a depressible valve, the air vent having exterior threading corresponding with the first threaded portion of the second cap.

4. The dispensing assembly of claim 3, wherein the second cap includes a central pin, and wherein when the second cap is secured to the air vent the central pin depresses the valve to enable ambient air to enter an interior of the container via the air vent to facilitate pouring liquids out of the container.

5. The dispensing assembly of claim 2, further comprising a flange provided on the proximal end portion of the spout and a corresponding ledge provided in the interior of the first cap, wherein rotation of the draw sleeve secures the flange to the ledge.

6. The dispensing assembly as defined in claim 2 wherein the spout is positioned and functions at all times, inside the draw sleeve and the passage.

7. The dispensing assembly as defined in claim 2 wherein the spout is placed at any desired position within the container prior to being manipulated by the draw sleeve.

8. The dispensing assembly as defined in claim 2 wherein the draw sleeve is positioned and functions on and above a multi-functional seal secured to a top edge of an upper extension of the first cap.

9. The dispensing assembly as defined in claim 2 wherein a proximal end outer flange of the spout is drawn to a ledge under the first cap in a sealed fashion by clockwise rotation of the draw sleeve.

10. The dispensing assembly as defined in claim 2 wherein movement from the retracted position to the extended position is accomplished by handling dry exterior surfaces of both the second cap and the draw sleeve.

11. The dispensing assembly as defined in claim 2 in which the exterior of the draw sleeve is kept dry in the retracted position by an upper seal housed in the second cap and a lower multi-functional seal.

12. The dispensing assembly as defined in claim 2 in which the sleeve is housed within the second cap in the retracted position.

13. The dispensing assembly as defined in claim 2 in which a multi-functional seal is secured to a top edge of an upper extension of the first cap to provide a lower seal for the draw sleeve in the retracted position.

14. The dispensing assembly as defined in claim 2 in which a multi-functional seal is secured to a top edge of an upper extension of the first cap to provide a base upon which the draw sleeve may function.

* * * * *